US011205530B1

(12) United States Patent
Watson et al.

(10) Patent No.: US 11,205,530 B1
(45) Date of Patent: Dec. 21, 2021

(54) TECHNIQUE FOR CONSTRUCTING HIGH GRADIENT INSULATORS

(71) Applicant: Triad National Security, LLC, Los Alamos, NM (US)

(72) Inventors: Scott Avery Watson, Jemez Springs, NM (US); Nicola Maree Winch, Los Alamos, NM (US); Eric Byron Sorensen, Los Alamos, NM (US); Lawrence Eugene Bronisz, Los Alamos, NM (US); David Platts, Los Alamos, NM (US); Michael L. Krogh, Los Alamos, NM (US); Marcelo Norona, Los Alamos, NM (US); Phillip A. Duran, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 190 days.

(21) Appl. No.: 16/217,021

(22) Filed: Dec. 11, 2018

Related U.S. Application Data

(60) Provisional application No. 62/598,188, filed on Dec. 13, 2017.

(51) Int. Cl.

| | |
|---|---|
| ***H01B 19/00*** | (2006.01) |
| ***H01B 17/28*** | (2006.01) |
| ***H01B 17/64*** | (2006.01) |
| ***H01B 17/66*** | (2006.01) |

(52) U.S. Cl.
CPC ..... *H01B 19/00* (2013.01); *H01B 17/28* (2013.01); *H01B 17/64* (2013.01); *H01B 17/66* (2013.01)

(58) Field of Classification Search
CPC ..... H01B 19/00; H01B 17/28; H01B 17/64; H01B 17/66
See application file for complete search history.

(56) References Cited

U.S. PATENT DOCUMENTS

| | | | | |
|---|---|---|---|---|
| 2,952,145 | A * | 9/1960 | Thompson | F16D 3/065 464/167 |
| 4,596,624 | A * | 6/1986 | Frohlich | H05K 3/4611 156/285 |
| 4,803,450 | A * | 2/1989 | Burgess | H01P 3/088 228/180.22 |
| 4,965,702 | A * | 10/1990 | Lott | H01L 21/4846 257/692 |
| 7,614,145 | B2 * | 11/2009 | Wakizaka | H05K 3/389 174/259 |
| 7,615,277 | B2 * | 11/2009 | Takai | C23C 18/1608 174/258 |
| 10,645,818 | B2 * | 5/2020 | Kakuishi | B23K 1/0016 |
| 2002/0104681 | A1 * | 8/2002 | Ishiwa | H05K 1/144 174/250 |

* cited by examiner

*Primary Examiner* — Paul D Kim
(74) *Attorney, Agent, or Firm* — LeonardPatel PC; Sheetal S. Patel; Michael A. Leonard, II

(57) ABSTRACT

A process for constructing a high-tensile strength, high-gradient insulator (HGI) may include stacking alternating layers of conductors and insulators, and vacuum pressure potting the stacked layers onto an insulating rod. The process may also include post machining the stacked layers to form a complete assembly of the HGI.

8 Claims, 7 Drawing Sheets

100

400

600

TECHNIQUE FOR CONSTRUCTING HIGH GRADIENT INSULATORS

CROSS-REFERENCE TO RELATED APPLICATION

This application claims the benefit of U.S. Provisional Patent Application No. 62/598,188 filed Dec. 13, 2017. The subject matter of this earlier filed application is hereby incorporated by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to high-voltage, high gradient insulators (HGIs), and more particularly, to a technique for constructing HGIs with high tensile strength.

BACKGROUND

The size of any high-voltage system is limited by the size of associated insulators. Consequently, utility of more compact insulators with higher electrical-breakdown strength is at a premium. In recent years, finely segmented, metal-on-insulator, otherwise known as "High Gradient Insulators" (HGIs) have become a prominent type of compact, high-performance insulator often displacing conventional insulators in accelerators and other vacuum systems.

Conventional HGIs, however, have low tensile-strength. This low tensile-strength limits applicability of the HGIs to compressive loading only.

Thus, an alternative technique for constructing HGIs may be more beneficial.

SUMMARY

Certain embodiments of the present invention may provide solutions to the problems and needs in the art that have not yet been fully identified, appreciated, or solved by conventional high-voltage, insulators. For example, some embodiments of the present invention pertain to a technique for manufacturing or construing HGIs. For example, this technique may provide desirable properties of HGIs, along with high tensile-strength of conventional insulators, opening a wide array of insulator improvements for high voltage devices—including x-ray generators, free-electron lasers, particle accelerators, pelletrons, and Van De Graff accelerators.

In an embodiment, a process for constructing high-strength HGI includes stacking alternating layers of conductors and insulators and vacuum pressure potting the alternated stacked layers onto an insulating rod. The process also includes post machining the stacked layers to form a complete assembly of the HGI.

In another embodiment, a process for constructing a high-tensile strength HGI includes cutting a multilayer circuit board into cylinders, wherein the multilayer circuit has alternate layers of conductors and insulators and stacking the cylinders within a soldering jig to make a rod. The process also includes placing a weight or applying an axial compression clamping force to the stack, placing the jig into an oven set at a predefined temperature for a predefined period of time, and removing the jig, allowing the jig, including the rod, to cool.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
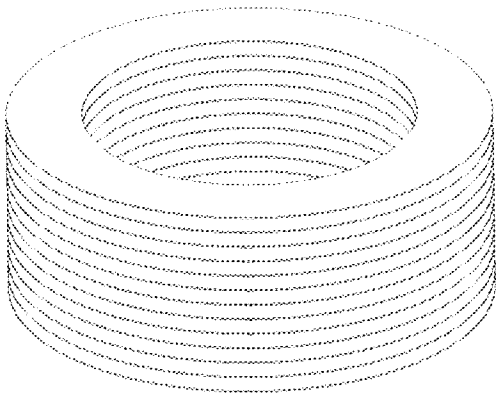
FIG. 1 is a schematic diagram illustrating a prospective view of stack-laminations, according to an embodiment of the present invention.

Some embodiments generally pertain to constructing a high-tensile-strength, high-gradient-insulator (HGI) using long stack-laminations of hollow conductive metal rings and hollow insulator rings bonded onto an insulator rod to help supply strength and to align and guide hollow insulator ring assembly. To accomplish this task, a plurality of stack-laminations are built using sub-assemblies of hollow conductive rings and hollow insulator rings. See, for example, FIG. 1, which is a schematic diagram illustrating a prospective view of stack-laminations 100, according to an embodiment of the present invention. Stack laminations 100 are typically constructed with alternating layers of conductors (e.g., stainless steel, copper, etc.) and insulators (e.g., Kapton, alumina, glass, acrylic, etc.).

Figure 2:
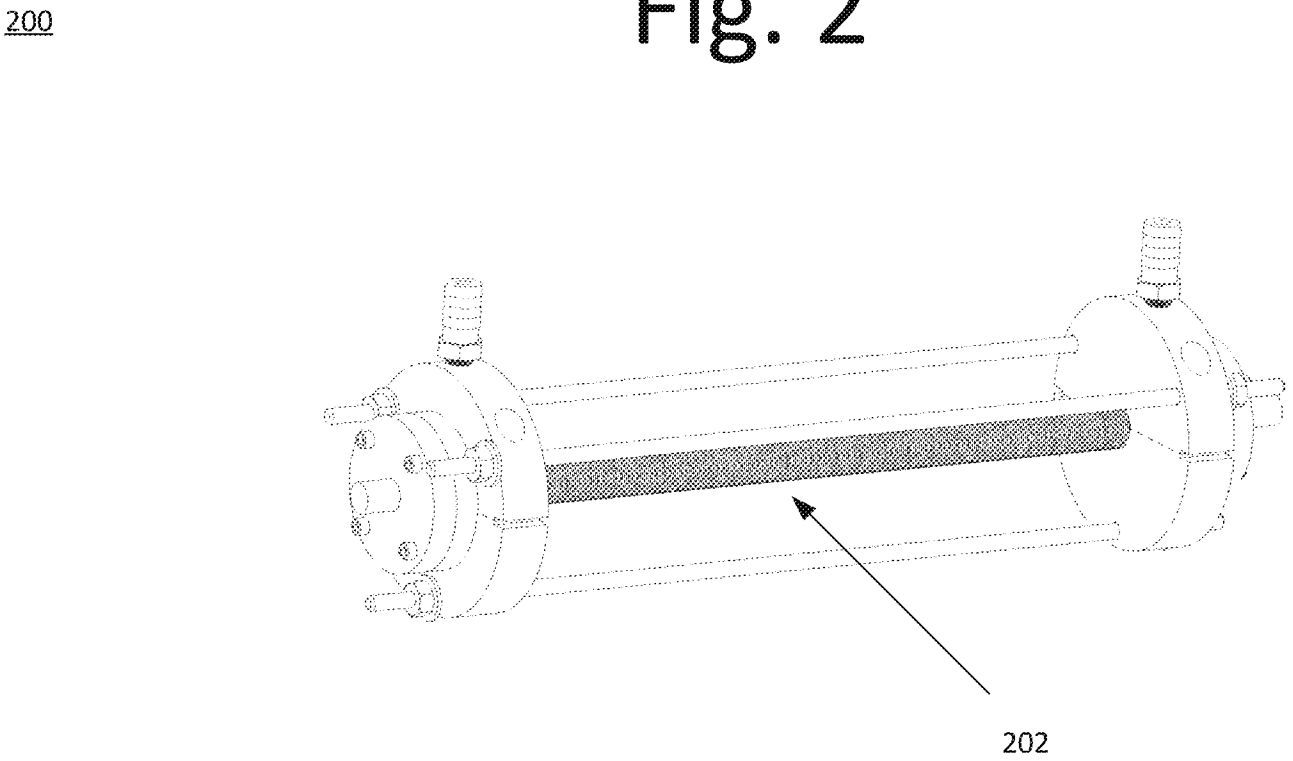
FIG. 2 is a schematic diagram illustrating a rod in a clamping fixture, according to an embodiment of the present invention.
Figure 3:
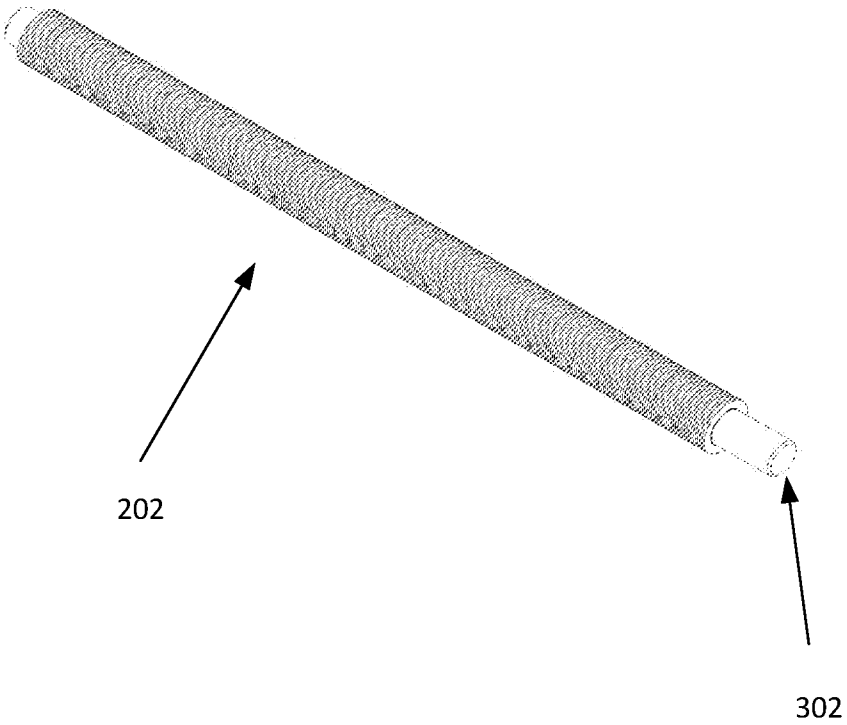
FIG. 3 is a schematic diagram illustrating a prospective view of assembly, according to an embodiment of the present invention.

In some embodiments, plurality of stack-laminations 100 are stacked and vacuum pressure potted onto insulating rods, which are then post machined to form a complete assembly. See, for example, FIG. 2, which is a schematic diagram illustrating a rod 202 in a clamping fixture 200, according to an embodiment of the present invention. This embodiment is just one possible configuration for vacuum potting a series of HGI rings onto a solid insulator rod 202. FIG. 3 is a schematic diagram illustrating a prospective view of a complete assembly 202, according to an embodiment of the present invention. Assembly 202 can be thought of as a stack of many, independent insulators that act as a series of capacitors in a capacitor divider. In addition to having bulk electrical breakdown properties of the insulator material, such a configuration also has the mechanical properties of the rod material—particularly tensile strength and machinability. Consequently, this configuration has the advantages of both a bulk insulator and a vacuum, HGI insulator.

One or more embodiments described herein pertain to methods of achieving tensile strengths of 750 to 1500 pounds per square inch tensile strength with additional methods to further improve tensile strength.

HGIs Construction Technique

Figure 4A:
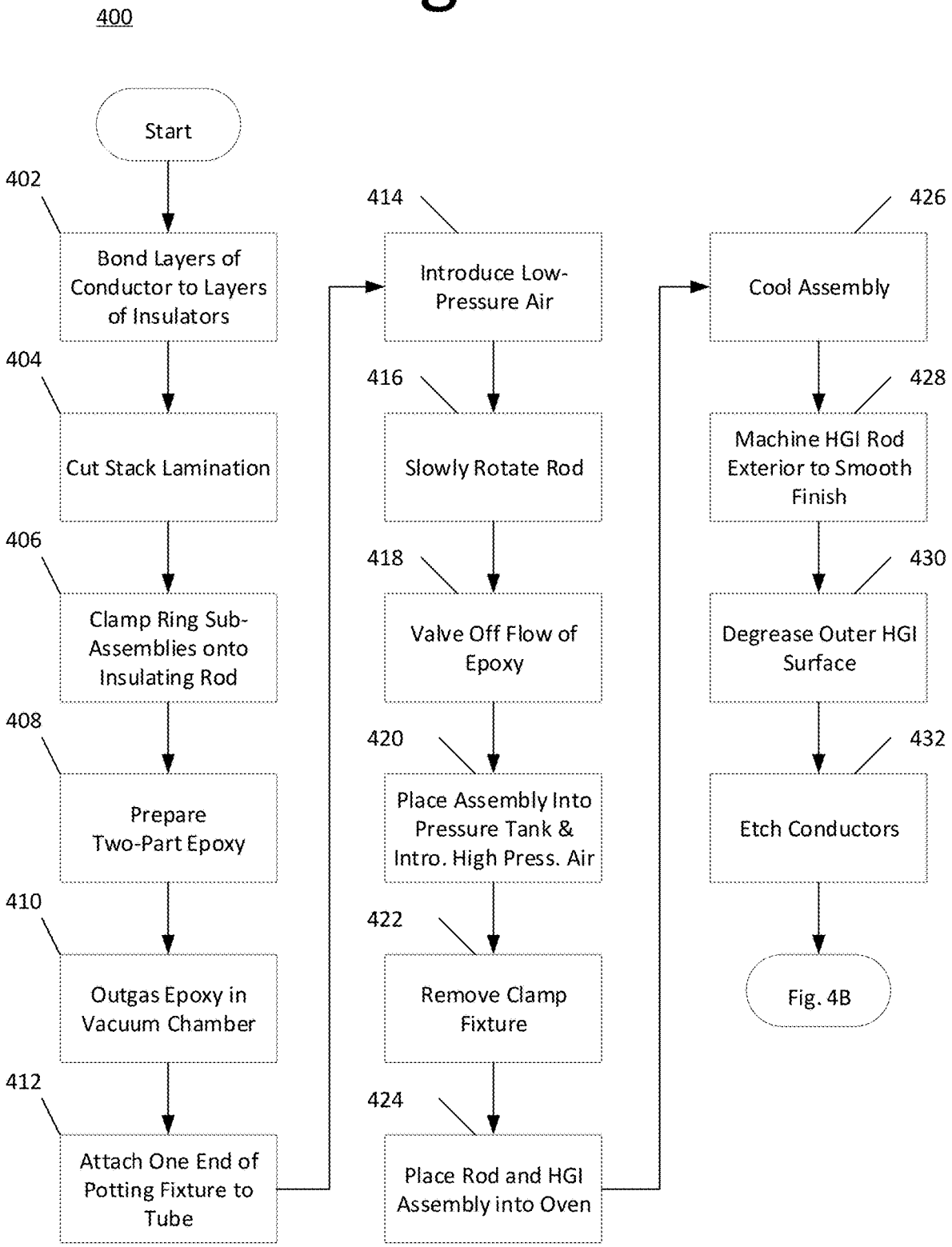
FIGS. 4A and 4B are flow diagrams illustrating flow diagram illustrating a process for constructing the stack-lamination ring subassemblies, according to an embodiment of the present invention.
Figure 4B:
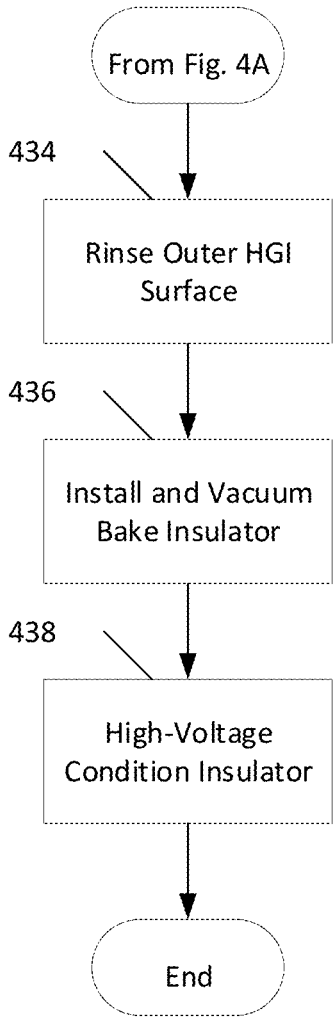

FIGS. 4A and 4B are flow diagrams 400 illustrating a process for constructing stack-lamination ring subassemblies, according to an embodiment of the present invention. In some embodiments, the stack-lamination ring subassemblies are constructed using a plywood-like sheet comprised of many (e.g., ~10 or more) alternating layers of a conductor and an insulator. Although these sheets may be manufactured many ways, in one embodiment thin stainless-steel layers are bonded to polyimide (or Kapton) sheets (or Cyrlex) using a polyimide bond at 402. The stainless-steel layers bonded with the polyimide sheets are heat-cured under pressure in a large isostatic heat press, for example.

At 404, these polyimide sheets (e.g., the cutting is of the stack lamination, not the individual sheets) are cut using one or more of the following techniques—water jet cutting or machining. In an embodiment, a CNC mill is utilized to rough cut individual rings. Care is taken to avoid rough edges from machining tools, or dimples from clamp fixtures, and/or ridges from the starting and stopping of the end mill. Typically, hundreds of rings can be machined from a single sheet.

At 406, these individual ring sub-assemblies are then clamped together on an alignment rod in a potting fixture. See, for example, FIG. 2 is a schematic diagram illustrating a prospective view of a clamping fixture 200 containing a rod 202, according to an embodiment of the present invention. In an embodiment, an alignment rod is removed and the slightly smaller diameter insulating rod (e.g., Vespel or Meldin 7001) 202 is then placed in the hole left by the alignment rod.

At 408, a two-part epoxy is prepared by mixing an appropriate ratio of epoxy resin and hardener (e.g., a 1:1 ratio by weight of EPON 815C and Vermasid 140). At 410, this two-part epoxy mixture (or outgas epoxy) is then placed in a vacuum chamber and pumped free of air to a modest vacuum (e.g., <10-2 Torr) to boil out volatiles in the epoxy mixture to remove bubbles.

In some embodiments, the components are cleaned with mild detergent and water removing any machining oils. Solvents, abrasives and plasma etching could also be used in an alternative embodiment. For example, plasma etch may be used to clean epoxy bonded metal faces in embodiments with coaxial rod. In addition, the end pieces of the potting fixture may be coated with mold release to enable the removal of set parts and reuse of components.

At 412, once the outgassed epoxy is prepared, one end of the potting fixture is attached to the vacuum chamber fill-tube, which is submerged in the epoxy. A tube at the other end of the potting fixture is open to the outside ambient air as shown in FIG. 2.

At 414, low-pressure (e.g., 10 psi) air is introduced into the vacuum chamber to push epoxy into the interstitial region between the insulating rod and the HGI rings. This process is performed with care to avoid the introduction of any bubbles into the epoxy mixture or the interstitial region. At 416, the rod is slowly rotated as the epoxy flows into the interstitial region to ensure that the region is completely filled.

At 418, once epoxy leaves the exit port, the flow of epoxy is valved (or shut) off and the potting fixture is placed in a chamber pressurized to approximately 100 PSI back-pressure to compress any small bubbles that remain in the assembly. The entire assembly is allowed to soft-set overnight in the pressure chamber.

At 420, once the assembly has soft-set, the assembly is placed into a pressure tank with the upper valve open and pressurized to approximately 100 psi while the epoxy is allowed to set. At 422, the clamp fixture is removed, and epoxy sprues are cut off and discarded leaving the rod and HGI assembly.

At 424, the rod and HGI assembly is then placed into an oven and heat-cured at 50-60 Celsius for 6 hours to cross-link the polymers in the epoxy layer. In some embodiments, the HGI assembly is placed in an oven to cross-link the epoxy.

At 426, once the cross-linking has been completed, the assembly is allowed to cool, and the rod is final-machined on a lathe using sharp tools, special clamp technique, machine rate and/or any other tool that would be appreciated by a person of ordinary skill in the art. For example, soft collets, like those made of nylon, may be utilized to prevent damage to the surface of the HGI layers. In some embodiments, the machining direction of the tool is from the insulator anode end toward the insulator cathode end.

At 428, the center insulating rod ends are machined to final form, which may utilize threads or other conventional fasteners to connect the high-tensile-strength HGI to the intended high-voltage system. In some embodiments, HGI rod exterior is machined to smooth finish.

At 430, once the outer HGI surface has been final machined, the outer HGI surface is degreased and the sub-assembly is cleaned with a water-based detergent to remove machining oils, and at 432, the assembly is placed in a ferric-chloride etching bath for 2-5 minutes at room temperature, or approximately 25 degrees Celsius to remove small metal burrs and/or microscopic rolled-edges in the metal layers. At 434, the outer HGI is then rinsed with de-ionized water and cleaned with ethyl alcohol. This etching step ensures that no electric-field enhancement points remain on the HGI outer surface. At 436, the insulator is installed and vacuum baked, and at 438, the insulator is conditioned at high-voltage.

It should be appreciated that in some embodiments the HGIs are typically utilized in a baked-out, vacuum system. This can be accomplished with conventional vacuum bake-out at approximately 100 Celsius for 24 hours, for example. The HGI insulators can also be "conditioned" using high-voltage discharge, and/or glow discharge to improve performance. Typically, HGI are used in vacuum systems with base pressures less than 1E-5 Torr.

Figure 5:
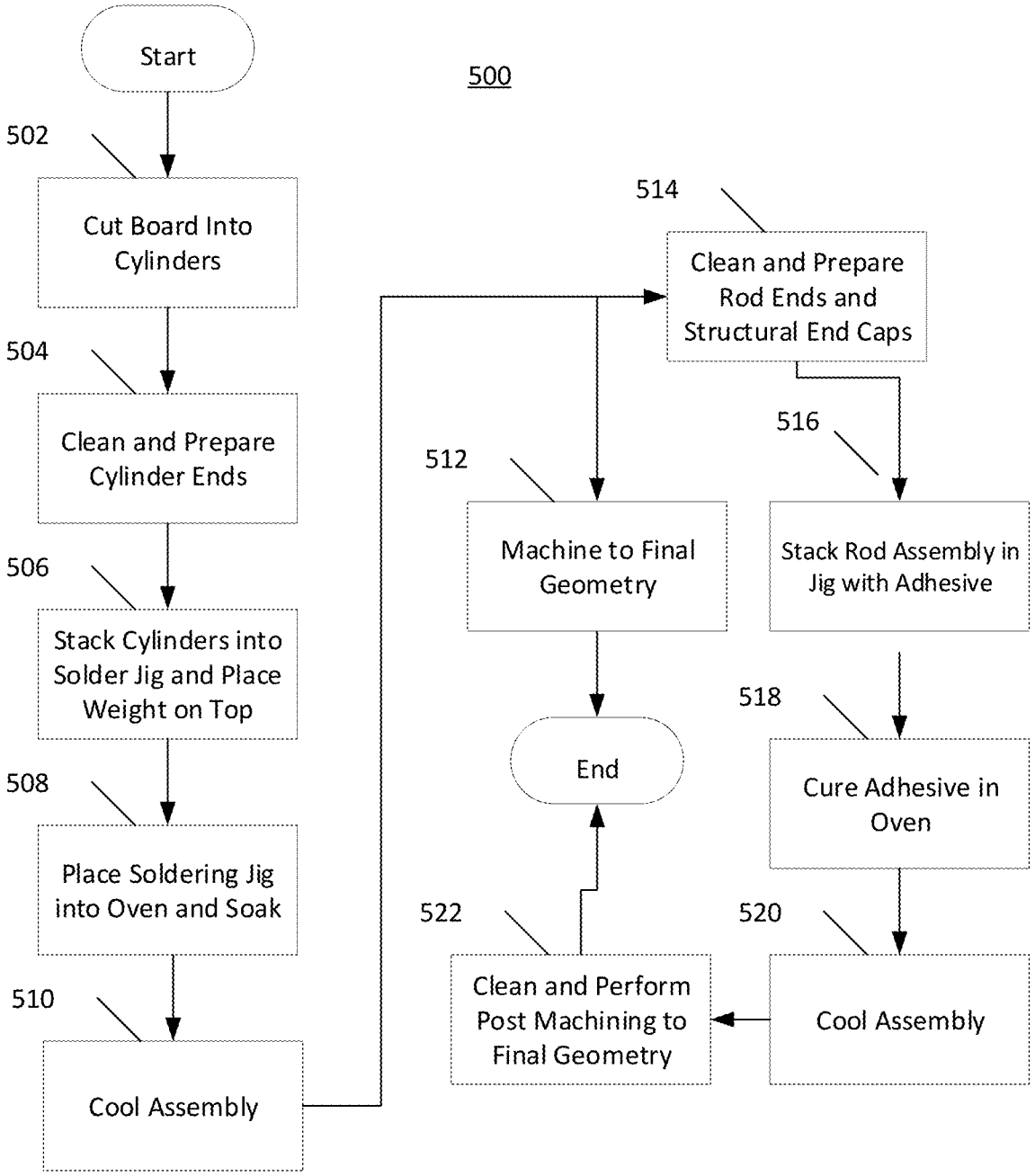
FIG. 5 is a flow diagram illustrating a process for constructing high gradient insulators, according to an embodiment of the present invention.

FIG. 5 is a flow diagram illustrating a process 500 for constructing high gradient insulators, according to an embodiment of the present invention. When copper is used as a conductor instead of stainless steel, the bond between copper and Kapton is much stronger. For instance, a multi-layer circuit board may include a layer (or layers) of Kapton, layers of bond ply adhesive film (e.g., a thin adhesive film between each layer), and conductive layers. The layers are stacked and thermally bonded in a press under vacuum. The bonded stack consists of a dielectric layers interspersed between each layer of metal, a layer of Kapton, followed by a layer of copper, and so forth, up to about a centimeter or more. In an embodiment, process 500 may begin with cutting the board, which may be usually in a rectangular sheet stack, into cylinders at 502. It should be appreciated that the embodiments are not limited to a circular or elliptical cross section of a cylinder or a constant cross section along the rod length (e.g. tapered).

At 504, the cylinders ends are prepared and cleaned for bonding. In some embodiments, the edges of the cylinders are deburred so that the faces are substantially planar. The faces are cleaned using water-based detergents, solvents, and/or abrasives, for example.

At 506, the cylinders are inserted (or stacked) within a titanium soldering jig, with the solder (or solder paste) placed between adjoining faces, to make a rod. In some embodiments, titanium is used for the jig because solder does no readily wet to its surface, preventing parts from sticking to the jig and enabling easy removal. Also, in some embodiments, the cylinders are bonded together with solder, which provides sufficient useful axial strength and melts at a temperature that will otherwise not damage the polyimide (Kapton) and copper cylinders.

At 508, the soldering jig is then placed in an oven, which has a temperature range capability of melting the solder or solder paste. Solder paste can contain flux which actively removes oxides from surfaces to be joined by the solder, thus improving wetting and final strength. Tensile strengths of 740 to 1500 psi can be achieved with a natural atmosphere (air) in the oven. The oven can be operated with a cover gas such as nitrogen (or a real inert gas such as argon or helium) in order to keep appreciable oxygen content from compromising surface wetting. A vacuum environment in the oven can also be used to preclude oxygen. With the use of a cover gas, inert gas, or vacuum, solder may be accomplished with less flux or without flux. Some embodiments may include using cover gas, inert gas or vacuum to increase tensile strength of rod assemblies. In some embodiments, the oven is set to a predefined temperature high enough to melt the solder between the cylinders to form a rod having high tensile strength. A lead free solder, which melts at 138 degrees Celsius, can be used or any solder, which does not exceed a temperature deleterious to the strength of the bonds or dielectric constituents of the cylinders. At 510, the rod and jig assembly is removed and allowed to cool or the rod and jig assembly can be left in the oven to cool as the oven cools. In an embodiment, at 512, the rod ends, including the structural ends caps (e.g., structural end caps 302 of FIG. 3), are machined to a final geometry. In some embodiment, however, structural ends may be excluded or may not be necessary.

In alternative embodiment, at 514, the rod ends, including the structural ends caps, are cleaned and prepared. At 516, when ends are use, stack rod assembly in jig with adhesive between the faces that are to be bounded. At 518, the adhesive is cured inside the oven at a predefined temperature (e.g., lower than solder melt temperature), and at 520, the adhesive is cooled. At 522, the adhesive is cleaned and post machining is performed to final geometry.

In a separate or alternative embodiment, the rod ends may be bounded onto the assembly at the same time as the solder bounds the cylinder, all of which is performed in a single operation. In this case, the oven is slowly cooled to a solder melting temperature (e.g., 138 degrees Celsius) or less, so the temperature remains at or slightly below the solder melting temperature for a longer period of time. This embodiment would essentially move steps 512 and 516 in between steps 506 and 508.

To enable easy attachment of the rods to other components of an assembly, non-conductive ends are attached to at least one end of the rod. In some embodiments, the non-conductive ends is polyimide. Polyimide is relatively difficult to bond with adhesives. For this reason, a special adhesive, such as Masterbond Supreme 10AOHT-LO, may be used. The special adhesive is a one-part epoxy adhesive that cures at a temperature below the solder melting temperature to allow ends to be bonded after rods are soldered into useful lengths. Rods of demonstrated strength were cured for a few hours at 150 degrees Celsius. The polyimide ends are prepared to bond effectively with the adhesive for rod attachment. The face, which will be bonded to an end of the rod, must have its surface roughened and cleaned. Roughening is best performed by abrasive means, such as sandpaper, followed by cleaning with a solvent such as isopropanol. Copper faces of abutting cylinders were also roughened. In addition, plasma etching may be performed to further clean and activate the polyimide surface prior to bonding. Plasma etching is performed in a partial pressure oxygen chamber with RF generated plasma. Plasma etching of both copper and polyimide faces enhances axial bond strength but may not always be necessary.

Figure 6:
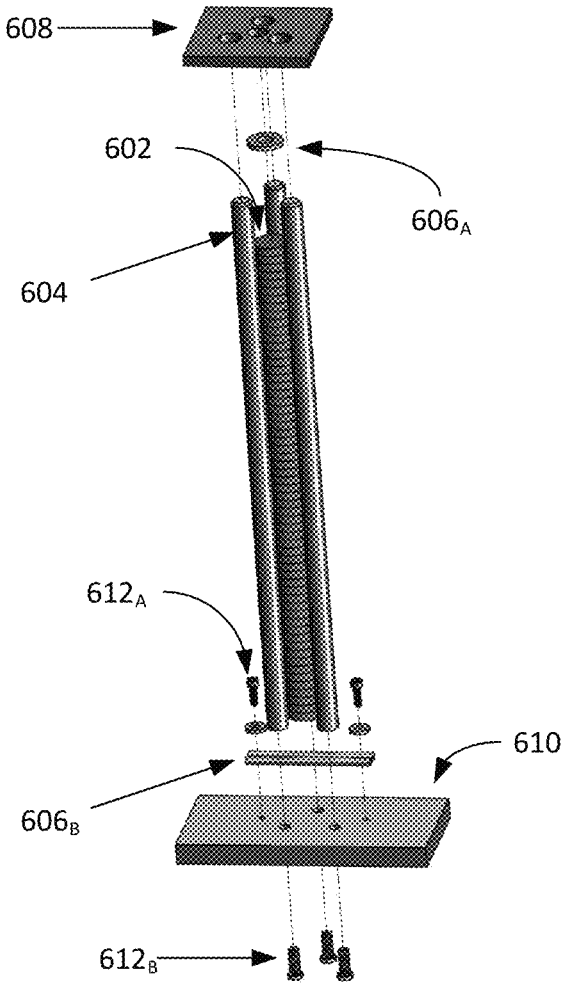
FIG. 6 is a schematic diagram illustrating a HGI cylinder stack, according to an embodiment of the present invention.

FIG. 6 is a schematic diagram illustrating a HGI cylinder stack 600, according to an embodiment of the present invention. In an embodiment, HGI cylinder stack 600 may include solder paste between all adjacent cylinder faces. HGI cylinder stack 600 includes a stack of cylinders 602 in between rods 604. Cylinders 602 are sandwiched between weight 608 and base 610. Spacers $\mathbf{606}_A$, $\mathbf{606}_B$ are used to separate cylinders 602 and respective weight 608 and base 610. In this embodiment, fasteners $\mathbf{612}_A$, $\mathbf{612}_B$ are used to secure cylinders 602 and rods 604 to base 610. Fasteners can be threads.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A process for constructing a high-tensile strength, high-gradient insulator (HGI), comprising:

cutting a multilayer circuit board into cylinders, wherein the multilayer circuit board comprising alternate layers of a conductor and an insulator;

stacking the cylinders within a soldering jig to make a rod;

placing solder or solder paste between adjacent cylinder faces;

placing a weight or applying an axial compression clamping force to the stack;

placing the jig into an oven set at a predefined temperature for a predefined period of time;

removing the jig from the oven and allowing the jig including the rod to cool;

cleaning and preparing the rod ends, including the structural ends caps and stacking rod assembly in the jig with an adhesive between the cylinder faces that are to be bounded;

curing the adhesive cured inside of the oven at a temperature lower than a solder melt temperature, and cooling the adhesive; and cleaning the adhesive and performing a post machining to final geometry.

2. The process of claim 1, wherein the multilayer circuit board comprises one or more combinations of one or more layers of Kapton, a thin adhesive film between each layer of the one or more layers of Kapton, and one or more conductive layers.

3. The process of claim 1, further comprising:

preparing and cleaning cylinder ends for bonding.

4. The process of claim 3, wherein the preparing and cleaning of the cylinder ends comprises deburring edges of the cylinders so that faces of the edges are substantially planar.

5. The process of claim 4, wherein the faces of the edges are cleaned using water-based detergents, solvents, fine grit abrasives, plasma etching, or any combination thereof.

6. The process of claim 1, wherein the predefine temperature within the oven is set to melt the solder between the cylinders to form the rod having the high tensile strength.

7. The process of claim 1, wherein the rod remains inside of the oven as the oven returns to room temperature.

8. The process of claim 1, wherein the predefined temperature is 20 degrees Celsius over a solder melting temperature.

* * * * *